US007750260B2

(12) United States Patent
Udelhoven et al.

(10) Patent No.: US 7,750,260 B2
(45) Date of Patent: Jul. 6, 2010

(54) LEADING AUXILIARY SWITCH FOR CIRCUIT BREAKER

(75) Inventors: Harald Udelhoven, Vettweiss (DE); Ali Shekarchi, Cologne (DE)

(73) Assignee: Eaton Industries GmbH, Bonn (DE)

( * ) Notice: Subject to any disclaimer, the term of this patent is extended or adjusted under 35 U.S.C. 154(b) by 646 days.

(21) Appl. No.: 11/578,658

(22) PCT Filed: Apr. 14, 2005

(86) PCT No.: PCT/EP2005/003935

§ 371 (c)(1),
(2), (4) Date: Oct. 16, 2006

(87) PCT Pub. No.: WO2005/101444

PCT Pub. Date: Oct. 27, 2005

(65) Prior Publication Data

US 2007/0272531 A1 Nov. 29, 2007

(30) Foreign Application Priority Data

Apr. 15, 2004 (DE) ..... 10-2004-018-252

(51) Int. Cl.
*H01H 1/36* (2006.01)

(52) U.S. Cl. ..... 200/252

(58) Field of Classification Search ..... 200/17 R, 200/400–401, 50.4, 329–331, 334, 501, 252, 200/337, 537, 573, 243, 50.37
See application file for complete search history.

(56) References Cited

U.S. PATENT DOCUMENTS 4,454,392 A * 6/1984 Rapp et al. ..... 200/61.67

(Continued)

FOREIGN PATENT DOCUMENTS

CN 1281582 1/2001

(Continued)

OTHER PUBLICATIONS

International Search Report for International No. PCT/EP2005/003935 mailed on Aug. 23, 2005.

*Primary Examiner*—Renee S Luebke
*Assistant Examiner*—Sean Kayes
(74) *Attorney, Agent, or Firm*—Leydig, Voit & Mayer, Ltd.

(57) ABSTRACT

A leading auxiliary switch includes an auxiliary switch housing for attachment to a circuit breaker. An operating slide is provided having a sliding edge and being supported so as to be movable in a first sliding direction. A contact carrier is provided supported so as to be movable parallel to the first sliding direction. The contact carrier includes a sliding nose and is movable in a first operating phase of the operating slide against an action of a contact pressure spring into an ON position of movable contacts with fixed contacts. A drive slide is supported in the auxiliary switch housing so as to be movable in a second sliding direction transverse to the first sliding direction, the drive slide including first and second opposed sliding surfaces extending at an angle to the first and second sliding directions. The sliding edge of the operating slide abuts against the first sliding surface in the first operating phase and is out of contact with the first sliding surface in the second operating phase.

7 Claims, 1 Drawing Sheet

U.S. PATENT DOCUMENTS

| | | | | |
|---|---|---|---|---|
| 5,665,947 | A * | 9/1997 | Falcon | 200/61.18 |
| 5,959,273 | A * | 9/1999 | Chou | 200/332.1 |
| 6,180,903 | B1 * | 1/2001 | Chen | 200/406 |
| 6,326,871 | B1 | 12/2001 | Freimuth et al. | |
| 6,359,244 | B1 | 3/2002 | Freimuth et al. | |

FOREIGN PATENT DOCUMENTS

| | | |
|---|---|---|
| CN | 1281583 | 1/2001 |
| DE | 3820113 | 11/1989 |
| DE | 3920822 | 1/1991 |
| DE | 4317656 | 1/1994 |
| DE | 19717236 | 10/1998 |
| DE | 19754071 | 7/1999 |
| DE | 19812503 | 12/1999 |

* cited by examiner

LEADING AUXILIARY SWITCH FOR CIRCUIT BREAKER

CROSS REFERENCE TO PRIOR APPLICATION

This is a U.S. national phase application under 35 U.S.C. §371 of International Patent Application No. PCT/EP2005/003935, filed Apr. 14, 2005, and claims benefit of German Patent Application No. 10 2004 018 252.3, filed Apr. 15, 2004, which is incorporated by reference herein. The International Application was published in German on Oct. 27, 2005 as 2005/101444 A1 under PCT Article 21(2).

The present invention relates to a leading auxiliary switch, in particular a motor-protective circuit breaker including an operating slide which is supported such that it can move in a first sliding direction, and a movably supported contact carrier, the contact carrier being moved, in a first operating phase of the operating slide, against the action of at least one contact pressure spring into the ON position of movable contacts with fixed contacts, and an actuating element of the circuit breaker being able to be operated in a second operating phase of operating slide while the contact carrier remains in the ON position.

BACKGROUND

A leading auxiliary switch is known from German Publication DE 197 54 071 C1. The auxiliary switch has an operating slide provided with a link slot which engages with a pivot lever acting upon a contact carrier. In a first operating phase, the contact carrier is pivoted into an ON position in a direction substantially perpendicular to the actuation direction of the operating slide and against the action of a torsion spring acting upon the pivot lever and of contact pressure springs. In a subsequent second operating phase, the operating slide travels further and operates an actuating element of a circuit breaker while the contact carrier remains in the ON position. The link slot has two contour sections which merge into one another at an angle of 80° to 100° and through which a pin projecting from the pivot lever passes during one of the operating phases, respectively. The boundary surfaces of said contour sections, in conjunction with the torsion spring, ensure that the pivot lever is in permanent contact with the operating slide and the contact carrier so as to avoid incorrect positions of the contact carrier.

SUMMARY

An object of the present invention is to provide a different way to implement such an auxiliary switch.

The present invention provides a leading auxiliary switch including: an auxiliary switch housing configured for attachment to a circuit breaker; an operating slide including a sliding edge and being supported so as to be movable in a first sliding direction; a contact carrier supported so as to be movable parallel to the first sliding direction, the contact carrier including a sliding nose and being configured to be moved, in a first operating phase of the operating slide, against an action of a contact pressure spring into an ON position of movable contacts with fixed contacts; an actuating element of the circuit breaker operable in a second operating phase of operating slide while the contact carrier remains in the ON position; and a drive slide supported in the auxiliary switch housing so as to be movable in a second sliding direction transverse to the first sliding direction, the drive slide including first and second opposed sliding surfaces extending at an angle to the first and second sliding directions. The sliding edge of the operating slide abuts against the first sliding surface in the first operating phase and is out of contact with the first sliding surface in the second operating phase, and the sliding nose of the contact carrier remains in contact with the second sliding surface under the action of the contact pressure spring.

BRIEF DESCRIPTION OF THE DRAWINGS

Further details and advantages of the present invention will become apparent from the exemplary embodiment described below with reference to the Figures, in which.

DETAILED DESCRIPTION

Located between the operating slide and the linearly movable contact carrier is a drive slide, which is also linearly movable. The contact carrier and the operating slide move parallel to each other and transversely to the drive slide. The drive slide is limited in its movement on one side relative to the operating slide, and the contact carrier is limited in its movement on one side relative to the drive slide. The at least one contact pressure spring avoids incorrect positions of the contact carrier. In the first operating phase, the motion transfer takes place between a sliding edge of the operating slide and a first sliding surface of the drive slide on one hand, and between a second sliding surface of the drive slide and the contact carrier on the other hand. In the second operating phase, the sliding edge moves out of the region of the first sliding surface while an actuating element of a circuit breaker connected to the auxiliary switch is moved by the operating slide generally into its ON position. Since the contact carrier abuts against the second sliding surface, it remains in the ON position.

In the second operating phase, a first contact surface adjoining the first sliding surface and extending in the first sliding direction and a second contact surface adjoining the sliding edge and extending in the first sliding direction slide on one another while ensuring that the drive slide remains in the ON position. Upon completion of the actuation, the drive slide and the operating slide are held in position by frictional adhesion resulting from the action of the contact pressure spring.

A defined OFF position of the contact carrier is ensured by a second boundary surface of the drive slide, said second boundary surface starting at the second sliding surface and extending in the second sliding direction.

The operating slide is advantageously angled to form a head portion for operating an ON button of the circuit breaker.

Figure 1:
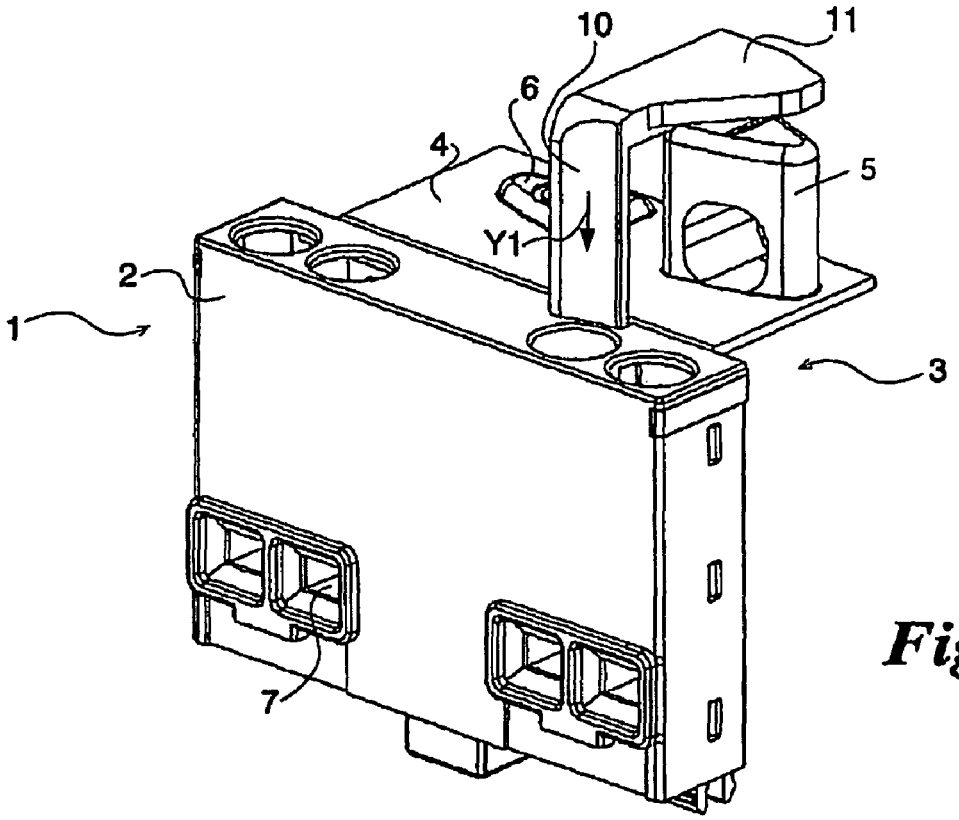
FIG. 1 is a simplified view of a leading auxiliary switch according to the present invention, mounted on a circuit breaker.

According to FIG. 1, leading auxiliary switch 1 is enclosed by a rectangular parallelepiped auxiliary switch housing 2 to be attached to a circuit breaker 3. The rudimentary illustration of circuit breaker 3 shows only a front portion of its switching device housing 4 as well as an actuating element 5 in the form of an ON button and a further actuating element 6 in the form of an OFF button. Auxiliary switch 1 has four connecting terminals 7, and an operating slide 10 projecting from auxiliary switch housing 2 at the front. Operating slide 10 is longitudinally movably guided in auxiliary switch housing 2 and is able to be moved in a first sliding direction Y1 from the OFF position shown to an ON position and in the opposite direction. When in the OFF position, angled head portion 11 of operating slide 10 covers actuating element 5 at a distance therefrom. When moving operating slide 10 from the OFF position to the ON position, head portion 11 approaches actuating element 5 in a first operating phase and moves actuating element 5 from the OFF position shown to a depressed ON position in a subsequent second phase.

Figure 2:
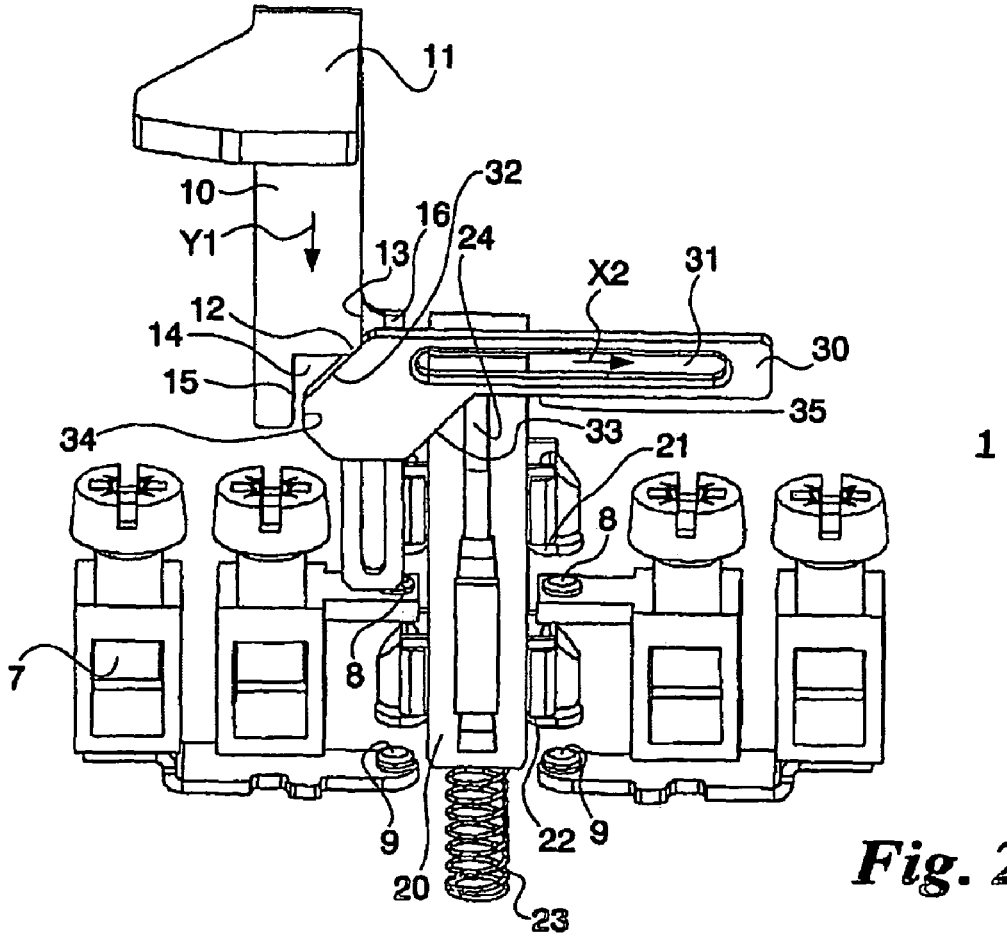
FIG. 2 shows the auxiliary switch of FIG. 1 with the auxiliary switch housing removed.

According to FIG. 2, two contact elements designed as make contacts are disposed inside auxiliary switch 1, said contact elements each including a pair of fixed contacts 8 or 9, and a movable bridging contact 21 or 22, respectively. Each of the fixed contacts 8, 9 is connected to one of the connecting terminals 7. Movable contacts 21, 22 are disposed one behind the other and with some play in a contact carrier 20, which in turn is longitudinally movably supported in auxiliary switch housing 2. A contact pressure spring 23 is braced between the end of contact carrier 20 facing away from head portion 11 of operating slide 10 and auxiliary switch housing 2. In order to move the open contact elements from the open position shown to the closed position, contact carrier 20 is moved parallel to first sliding direction Y1 from the OFF position shown to the ON position. In order to open the contact elements, contact carrier 20 is moved in the opposite direction.

Moreover, a drive slide 30 is longitudinally movably supported in auxiliary switch housing 2. For this purpose, an elongated guide opening 31 of drive slide 30 cooperates in a known manner with suitable guide pins of auxiliary switch housing 2. Drive slide 30 is disposed between the end of operating slide 10 facing away from head portion 11 and the end of contact carrier 20 facing away from contact pressure spring 23. Drive slide 30 is movable in a second sliding direction X2 and in a direction opposite thereto, said second sliding direction being transverse to first sliding direction Y1. Drive slide 30 is provided with two substantially plane sliding surfaces 32, 33 extending parallel to each other. Sliding surfaces 32, 33 are oriented at an angle with respect to the two sliding directions Y1, X2. First sliding surface 32 faces operating slide 10, and second sliding surface 33 faces contact carrier 20.

A plane first contact surface 34 adjoins first sliding surface 32 in and parallel to first sliding direction Y1. Operating slide 10 is provided with a sliding edge 12 at its end facing away from head portion 11, said sliding edge being adjoined by a plane second contact surface 13 which extends in first sliding direction Y1 toward head portion 11. At its end located in auxiliary switch housing 2, operating slide 10 is provided with a step recess 14 which is set back with respect to drive slide 30 and which includes a plane first boundary surface 15 extending in first sliding direction Y1. A plane second boundary surface 35 adjoins second sliding surface 33 in and parallel to second sliding direction X2. Contact carrier 20 is provided with a sliding nose 24 at its end directed toward drive slide 30.

In the OFF position, first boundary surface 15 of operating slide 10 faces the first contact surface 34 of actuating slide 30 and serves, on the one hand, to facilitate the assembly of auxiliary switch 1 and, on the other hand, to improve the guidance of operating slide 10 in conjunction with guide means customary in the art disposed in auxiliary switch housing 2.

In the OFF position shown in FIG. 2, on the one hand, sliding edge 12 of operating slide 10 is located on first sliding surface 32 of drive slide 30 in the end region facing head portion 11 and, on the other hand, sliding nose 24 of contact carrier 20 is located on second boundary surface 35 in the end region merging into second sliding surface 33 of drive slide 30.

During the first operating phase, sliding edge 12 slides on first sliding surface 32, thereby moving drive slide 30 in second sliding direction X2. As a result of this movement, sliding nose 24 slides on second sliding surface 33 from the end adjacent to second boundary surface 35 to the opposite end, thereby moving contact carrier 20 parallel to first sliding direction Y1 against the force exerted by contact pressure spring 23. In the process, movable contacts 21 and 22 come into contact with fixed contacts 8 and 9, respectively. The counteraction of contact pressure spring 23 is transferred from contact carrier 20 via drive slide 30 to operating slide 10. The first operating phase ends when sliding edge 12 has reached the end of first sliding surface 32 facing away from head portion 11.

At the beginning of the subsequent second operating phase, sliding edge 12 moves out of contact with first sliding surface 32, while, subsequently, second contact surface 13 slides along first contact surface 34. Since both contact surfaces 13, 34 extend parallel to first sliding direction Y1, drive slide 30 and contact carrier 20 will therefore not be moved any further. During the second operating phase, head portion 11 presses actuating element 5 (ON button) of circuit breaker 3 into switching device housing 4.

When operating slide 10 is released, the force of contact pressure spring 23, which is transferred to drive slide 30 through contact carrier 20, causes first contact surface 34 to abut against second contact surface 13, as a result of which operating slide 10, which has clearly visibly assumed the ON position, is inhibited from moving out of said ON position, either by itself or due to vibrations or shocks. When operating the further actuating element 6 (OFF button) of circuit breaker 3 by pressing it into switching device housing 4, actuating element 5 (ON button) is moved out of switching device housing 4 by a switching mechanism of circuit breaker 3, thereby forcibly moving operating slide 10 via head portion 11 in a direction opposite to first sliding direction Y1. During this movement, second contact surface 13 of operating slide 10 moves out of contact with first contact surface 34 of drive slide 30, whereupon the released force of the contact pressure spring 23 causes contact carrier 20, drive slide 30, and operating slide 10 to assume the OFF position shown in FIG. 1. A stop nose 16 laterally projecting from operating slide 10 cooperates with auxiliary switch housing 2 in such a manner that, on the one hand, operating slide 10 is prevented from falling out of auxiliary switch housing 2 and, on the other hand, a positive OFF position of operating slide 10 is provided by the action of contact pressure spring 23.

What is claimed is:

1. A leading auxiliary switch comprising:

an auxiliary switch housing configured for attachment to a circuit breaker;

an operating slide including a sliding edge and being supported so as to be movable in a first sliding direction;

a contact carrier supported so as to be movable parallel to the first sliding direction, the contact carrier including a sliding nose and being configured to be moved, in a first operating phase of the operating slide, against an action of a contact pressure spring into an ON position of movable contacts with fixed contacts;

an actuating element of the circuit breaker operable in a second operating phase of operating slide while the contact carrier remains in the ON position; and a drive slide supported in the auxiliary switch housing so as to be movable in a second sliding direction transverse to the first sliding direction, the drive slide including first and second opposed sliding surfaces extending at an angle to the first and second sliding directions;

wherein the sliding edge of the operating slide abuts against the first sliding surface in the first operating phase and is out of contact with the first sliding surface in the second operating phase, and wherein the sliding nose of the contact carrier remains in contact with the second sliding surface under the action of the contact pressure spring.

2. The leading auxiliary switch as recited in claim 1 wherein the drive slide includes a first contact surface and the operating slide includes a second contact surface, the first contact surface adjoining the first sliding surface and extending in a direction parallel to the first sliding direction, the first contact surface abutting against the second contact surface in the second phase of movement, said second contact surface extending parallel to the first sliding direction and adjoining the sliding edge in a direction opposite to the first sliding direction.

3. The leading auxiliary switch as recited in claim 2 wherein the drive slide includes a second boundary surface adjoining the second sliding surface and running in a direction parallel to the second sliding direction.

4. The leading auxiliary switch as recited in claim 2 wherein, in a region exterior to the auxiliary switch housing, the operating slide includes an angled portion forming a head portion configured for operating the actuating element, the actuating element including an ON button.

5. The leading auxiliary switch as recited in claim 1 wherein the drive slide includes a second boundary surface adjoining the second sliding surface and extending in a direction parallel to the second sliding direction.

6. The leading auxiliary switch as recited in claim 5 wherein, in a region exterior to the auxiliary switch housing, the operating slide includes an angled portion forming a head portion configured for operating the actuating element, the actuating element including an ON button.

7. The leading auxiliary switch as recited in claim 1 wherein, in a region exterior to the auxiliary switch housing, the operating slide includes an angled portion forming a head portion configured for operating the actuating element, the actuating element including an ON button.

* * * * *